US006370800B1

(12) United States Patent
Hung

(10) Patent No.: US 6,370,800 B1
(45) Date of Patent: Apr. 16, 2002

(54) SHOES WITH AIR PUMPS

(76) Inventor: Cheng-Che Hung, No. 255, Pi-Chung Street, Yen-Cheng Dist., Kaohsiung City (TW)

( * ) Notice: Subject to any disclaimer, the term of this patent is extended or adjusted under 35 U.S.C. 154(b) by 0 days.

(21) Appl. No.: 09/688,246

(22) Filed: Oct. 16, 2000

(51) Int. Cl.[7] ..... A43B 7/06
(52) U.S. Cl. ..... 36/3 B; 36/29
(58) Field of Search ..... 36/28, 29, 3 R, 36/3 B

(56) References Cited

U.S. PATENT DOCUMENTS 1,660,698 A * 2/1928 Williams, Sr. ..... 36/3 B
1,809,323 A * 6/1931 Williams, Sr. ..... 36/3 B
2,003,646 A * 6/1935 De Blasio ..... 36/3 B
2,315,391 A * 3/1943 Blair ..... 36/3 B
4,417,407 A * 11/1983 Fukuoka ..... 36/3 B
5,138,775 A * 8/1992 Chu ..... 36/3 B
5,195,254 A * 3/1993 Tyng ..... 36/3 R
5,477,626 A * 12/1995 Kwon ..... 36/3 B
6,085,444 A * 7/2000 Cho ..... 36/3 B

* cited by examiner

*Primary Examiner*—M. D. Patterson
(74) *Attorney, Agent, or Firm*—Birch, Stewart, Kolasch & Birch, LLP

(57) ABSTRACT

A shoe with an air pump therein, and especially to a shoe assembled with an air pump, uses the dynamic force from the user which can be converted into the energy for the air pump so that outer air can be taken in and transferred in the surplus space of the shoe. Air is absorbed, then is transferred to the front of the foot at the inner side of the shoe, and then is vented out through gaps in the shoe surface so that air circulates between the interior and exterior of the shoe. Thus, the shoes are permeable and cooled so that the wearer will feel comfortable. The assembly is suitable for various shoes and will not cause dramatic variations in the appearance of the shoes.

5 Claims, 5 Drawing Sheets

SHOES WITH AIR PUMPS

BACKGROUND OF INVENTION

1. Field of the Invention

The present invention relates to a shoe with an air pump. In the present invention, a plasticized inflation air pump for absorbing and transferring air is installed in a shoe. As the wearer walks, the dynamic force can be converted into the energy of the air pump so that outer air can be absorbed and transferred in the surplus space of the shoe. In the present invention, air is absorbed, then is transferred to the front foot at the inner side of the shoe, and then is vented out through gaps in the shoe surface so that air circulates between the interior and exterior of the shoe. Thus, the shoes are permeable and cooled so that the wearer will feel comfortable.

2. Description of the Related Art

In general, peoples wear shows outdoors for protecting their feet. However, since the shoes enclose the feet for a long period of time, heat within the shoe cannot be emitted sufficiently. Thus, the foot sweats making a foul odor so that the wearer will feel uneasy. Furthermore, since the shoe is worn for a long period of time, air in the shoe does not flow so as that heat is generated in the shoe. Therefore, the permeation of the shoe is a problem for the shoemaker. However, many prior art designs aims to resolve this problem, but no one has yet presented a good solution. The defects of the prior art designs are:

In a prior art design, the lateral side of a shoe is formed with two holes so as to achieve the object of air communication. However, since the foot fills most of the space in the shoe and thus space for flowing air is limited, the effect of this design is partial, and no means may be used to absorb air into the shoe. Thus, the function of the two holes is finite. Other ways like this encounter the same problem.

SUMMARY OF THE INVENTION

Accordingly, the primary object of the present invention is to provide a shoe with an air pump for a shoe. The dynamic force from the user can be converted into the energy for the air pump so that outer air can be absorbed and transferred in the surplus space of the shoe. In the present invention, air is absorbed, then is transferred to the front foot at the inner side of the shoe, and since the air in the shoe has a large density than the outer environment, and thus, air will sent out through gaps in the shoe surface so that air is circulated between the interior and exterior of the shoe. The air pump in installed in the surplus space of the sole and thus it is suitable for various shoes and does not cause a dramatic variation in the appearance of the shoes.

The aspect of the present invention is that an air pump for providing air is installed in a shoe, and air transfer conduits are installed at inner layer of the rear section. External air is guided into the shoe from the highest portion of the shoe. The air pump is installed in the rear portion of the sole, which has the function of air absorption and transfer. The valve of the piston is formed as a hemi-cone protrusion for completely isolating air. Furthermore, the movement of the wearer will not induce a deformation or displacement. Furthermore, no noise is generated as air flows. The lobe shape air bag in the front foot is formed with slits so that air may flow therein. As the lobe shape air bag bends, it will act as a blower to push air everywhere so that the air flows within the shoe and heat is dissipated in the shoe.

The advantage of the present invention is described in the following.

1. The upper layer of the air pump is installed as a round lobe protrusion. In use, it is pressed and driven upwards and downwards for a long time, the pressure and impact are strong, and thus, it is necessary to be strengthened. Generally, a shoe must be worn ten hours daily, at least two hours the wearer walks with the shoe. Therefore, about 1000 impacts applies to the air pump, and thus, the requirement in quality is severe. Therefore, in design, a round lobe protrusion is formed to absorb and buffer the impacts. Therefore, the body of the air pump accepts a reduced force and the lifetime of the shoe is prolonged. Otherwise, after the shoes are worn in a short period of time, the elastic fatigue in the air pump will induce the user to feel uncomfortable. A plurality of radiating slits are installed in the center of the shoe heel, which are arranged in a round shape or a plurality of round hollow notches are formed. The sizes thereof are fitted to the round lobe protrusion. The round lobe protrusion is not affected by the center bottom of the sole. As a result, in moving, the round lobe protrusion may function effectively.

2. Cylinders in the air pump are formed from the lowermost layer to a level from the plane of the sole with 3 mm. When the heel of the wearer is pressed, an impact applies to the air pump, the air pump will not be sunk too much so that the bottom of the foot has a higher front side and a lower rear side so as to tilt backwards or even to fall down. If the rear heel and the rear shoe have a large elevation difference, the user will feel uncomfortable. Moreover, the shoe of the present invention has the functions of shock absorption and buffering.

3. The hemi-cone protrusion pistons on the air absorbing and venting air valves can be controlled. As the wearer walks, the impact on the sole will induce the air can be isolated outsides. The lateral side of the air pump and the lateral wall of the two air valves at the front end are installed with respect to a hemi-cone protrusion pistons which have hardness different from the air pump, i.e., softer than the air pump, so as to tightly seal the round air valves as a plug of a bottle. According to the plasticity, as the air pump is pressed, since the applied force is not uniform, it is often that the round air valves are pressed non-uniformly. While they can be supported so that the air pump is impacted, it will not deform due to the air valves, and thus, the air valve has the function of isolating air. Meanwhile, the lower layer of the hemi-cone protrusion is a flat piece so as to effectively control the hemi-cone protrusion press the air valve too much so that it can be easily released from the round air valve for absorbing air or venting air. The height of the hemi-cone protrusion is much larger than the thickness of the wall of the air valve. The lower bottom combines the left and right edges and the sidewall of the air pump. The hemi-cone protrusion piston in the center is steadily combined with the round air valves so that the whole hemi-cone protrusion piston flatly adheres to the wall of the air pump. However, the combination is not complete, it has a function of driving.

The way for absorbing and ventilating air is that the inner side at the rear heel of the air pump has an air valve, the inner wall thereof is assembled with hemi-cone protrusion piston and the hemi-cone protrusion is supported from the inner side to the outer side. The round air valve serves to absorb air and seal air. The outer wall of the air valve in front of the air pump is assembled with a hemi-cone protrusion piston. The hemi-cone protrusion is supported. The round air valve has the function of venting and sealing. When the bottom of the heel lifts to leave from the protruding surface at the upper round lobe of the air pump, the round lobe protrusion also moves upwards. The volume of the air pump will enlarge so as to be in a half vacuum. The hemi-cone protrusion at the air valve has a vacuum effect. The air out of the air pump has a density larger than that in the air pump, therefore, air is pushed forwards from the air hole toward the air pump so that the hemi-cone protrusion will be pushed away and then releases from the air valve. Thus, air can enter into the air pump therefrom. At the same time, the air valve in the front side of the air pump will be pushed forwards, and therefore, the hemi-cone protrusion of the air valve will extrude inwards further so as to be sealed completely and thus air is isolated. When the heel touches the ground so as to press the round lobe protrusion of the air pump, the content of the air pump is reduced. The density of the air inside is larger than that from outside so that air pushes outwards. Thus, the frustrated cone protrusion on the front air valve pushes outwards to release from the air valve. Therefore, air in the air pump will exhaust out to push to the front air transfer conduit to the front foot. At the same time, the air valve at the lateral side of the air pump will extrude outwards. Therefore, the hemi-cone protrusion on the air valve will further extrude and then is sealed completely so that the air is closed therein. The air valve at the lateral side of the rear side of the air pump only absorbs air without venting air while the air valve in the front end only exhausts air without absorbing air. In walking, the heel moves upwards and downwards, by the operation of the air pump and the control of the piston on the air valve so that outer air is transferred to the front foot.

Under construction from fatigue of the object, the present invention is endurable to the impact. The impact to the air pump at any time and any level because the air valve and the air pump being pressed can restore to the original state rapidly for retaining the effect in a long time and will not deform due to non-uniform outer force. In the normal state, an impact force is generally at least 60 kilograms of the weight of an adult. A common air valve cannot suffer this impact over a long time period. It will deform rapidly and lose its effect. Since air flows through the valve, whistle sound will generate, while the round air valve and a piston have no such condition.

4. The airflow buffer at outer side of the air valve and the function thereof:

When airflows through a narrow section, the molecules of air will extrude with each other so as to generate a whistling sound. In a normal breath, no sound will be generated, while as one breathes strongly, then a sound will be emitted. Therefore, at the rear heel, the air valve of the air pump is left with a spacer so that the air transfer conduit will not directly communicate with the air valve. Otherwise, the air transfer conduit must be made with a large size for avoiding in a drastic movement, and it is extruded by air to produce sound.

5. Designs and function of the air transfer conduit in the center of the sole and the lobe shape air bag:

The center of the sole and the front foot are left with a trench and a groove for placing the air transfer conduit and lobe shape air bag. When the air pump in the heel pushes air into the two air transfer conduits, air will be guided to the lobe shape air bag. Each of the lobes is formed in a spacing air chamber. The surface thereof has lobes arranged thereon so as to be formed as isolating air chambers. Each lobe is spaced by a stripe 3 mm wide. The stripes are formed as a supporting frame from the lower layer to the surface of the sole. There are several 3 mm-width gaps formed therein. Therefore, air in the air chambers in the air bag is in communication, and thus, air flows between each air chamber. Since gaps are formed in each lobe, as the front foot sole bends, the lobe shape air chamber serves to cancel the compression from the air bag. By the driving of the bending of a foot, the volume of each lobe is changeable to extrude air into different lobes. The gaps are formed due to the depression of the lobe, so that air will flow into the shoe, as a blower blows air into each air chamber. The lobes in the surface are used for preventing depression as they are bent. Moreover, the lobes may absorb the momentum from extrusion so that the material will not fatigue due to frequent pressure and driving and thus has a preferred strength and tolerance. Therefore, in the design of the portion with respect to front foot, lobe shape air bags as a bank of blowers are formed, so that when the foot is bent or driven, the pressure can be buffered and the volume is not changed. The lobe shape air bag will enclose the foot. The air from the air pump will transfer to the shoe from the small holes in the shoe pad and the slits and then will be transferred out.

6. The special design and function aims for each of the air supplies to be operated independently. That is, air is transferred unidirectionally from the rear section of the shoe to the air pump at the rear side of the sole. The air is then compressed by air pump so as to push the air into the lobe shape air bag in the front foot of the sole. By a blowing effect, air is emitted from slits to the shoes and then is vented out.

The various objects and advantages of the present invention will be more readily understood from the following detailed description when reading in conjunction with the appended drawing.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
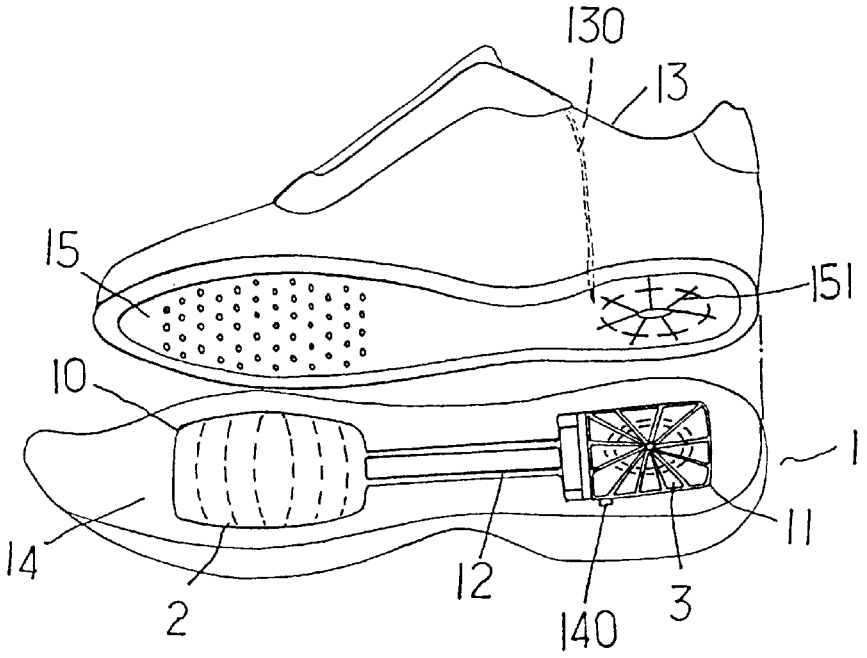
FIG. 1 is an exploded perspective view of the present invention.
Figure 2:
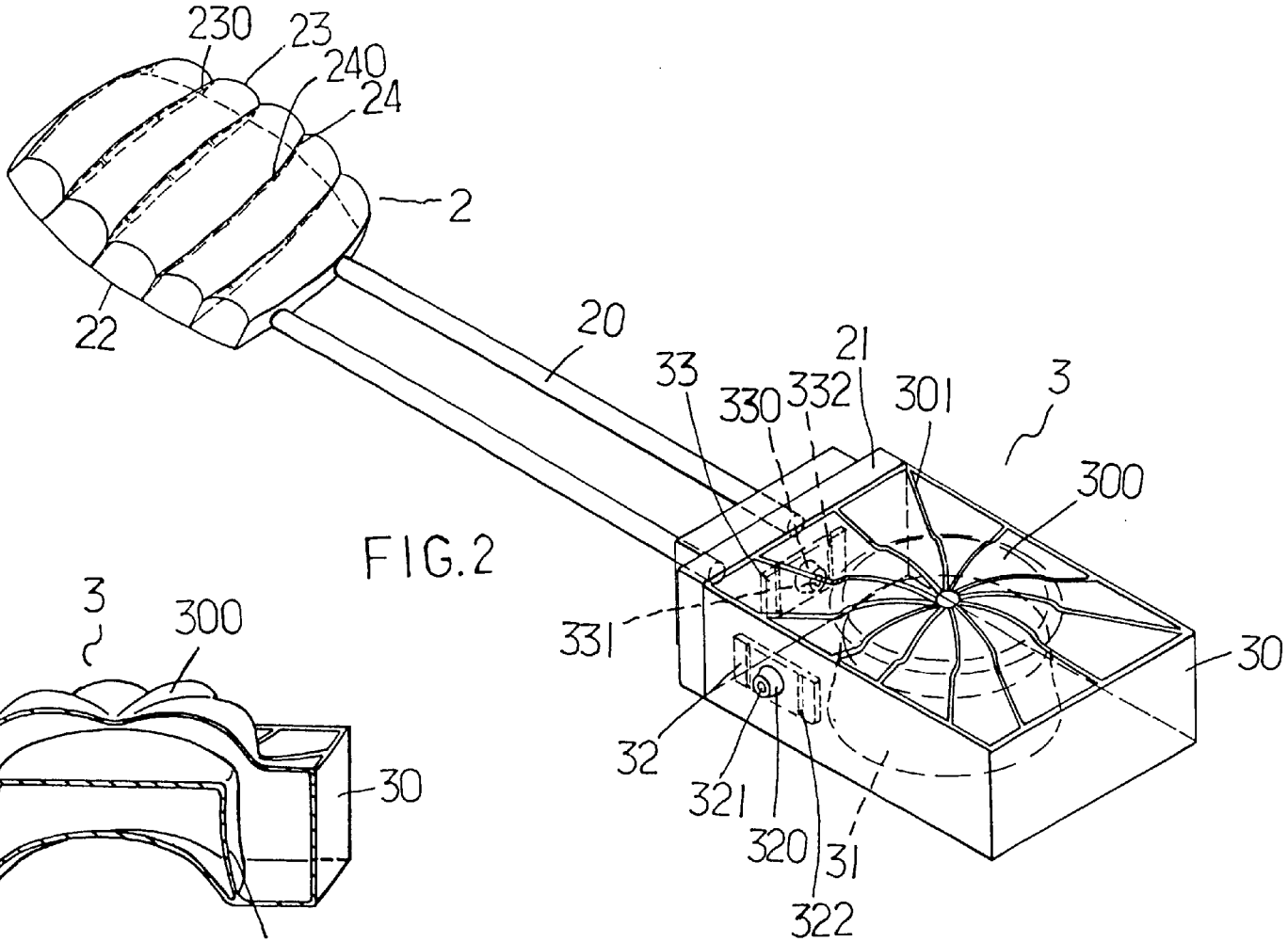
FIG. 2 is a perspective view showing the assembly of the lobe shape air bag and the air pump of the present invention.

With reference to FIGS. 1 and 2, in the present invention, the front end and rear end of an upper surface of a sole 1 are formed with respective grooves 10 and 11 which serve to receive a lobe shape air bag 2 and an air pump 3. Moreover, trenches 12 are placed between the grooves 10 and 11. Air transfer conduits 20 are inserted into trenches 12. As seen in FIG. 2, the right side of the air transfer conduit 20 is installed with an air chamber 21 for buffering ventilate air and reducing the whistle from the air. The air chamber 21 is placed in the groove 11 at the rear section of the sole 1 so as to be connected to the lobe shape air bag 2 via the air transfer conduits 20.

Figure 3:
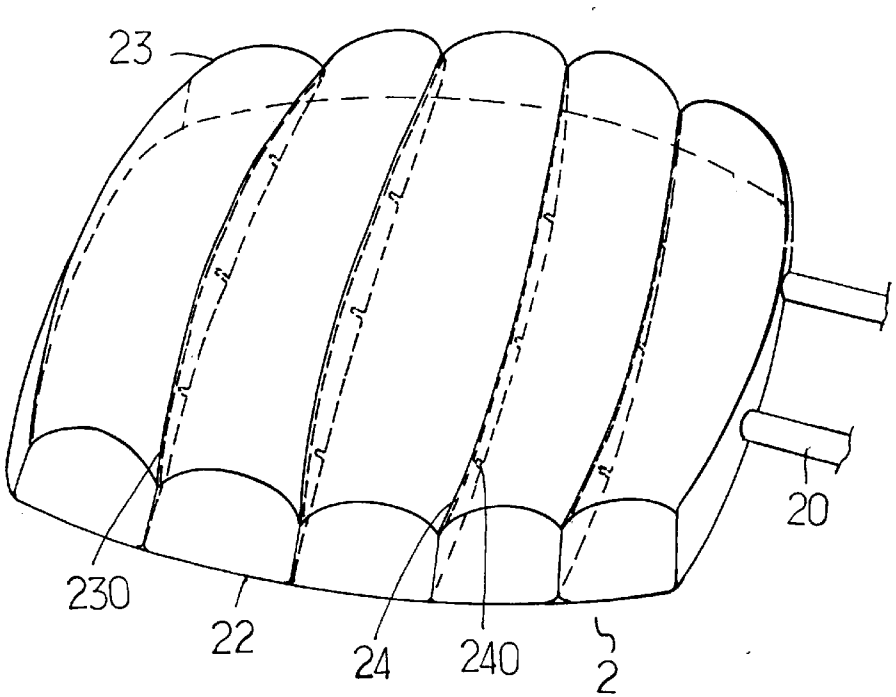
FIG. 3 is a portion of the lobe shape air bag of the present invention.

The air bag 2 has a long flat shape (see FIG. 3), and on the surface thereof, lobes 23 are arranged so as to be formed as isolating air chambers. Each lobe is spaced by a stripe 24 of 3 mm width. The stripes are formed as a supporting frame from the lower layer to the surface of the sole. There are several 3 mm width gaps formed therein. Therefore, air in the air chambers in the air bag 2 is circulated and air flows between each air chamber. Since gaps 230 of 3 mm width are formed in each lobe 23, as the front foot sole bends, the lobe shape air chambers serve to cancel the compression from the air bag 2.

Figure 9:
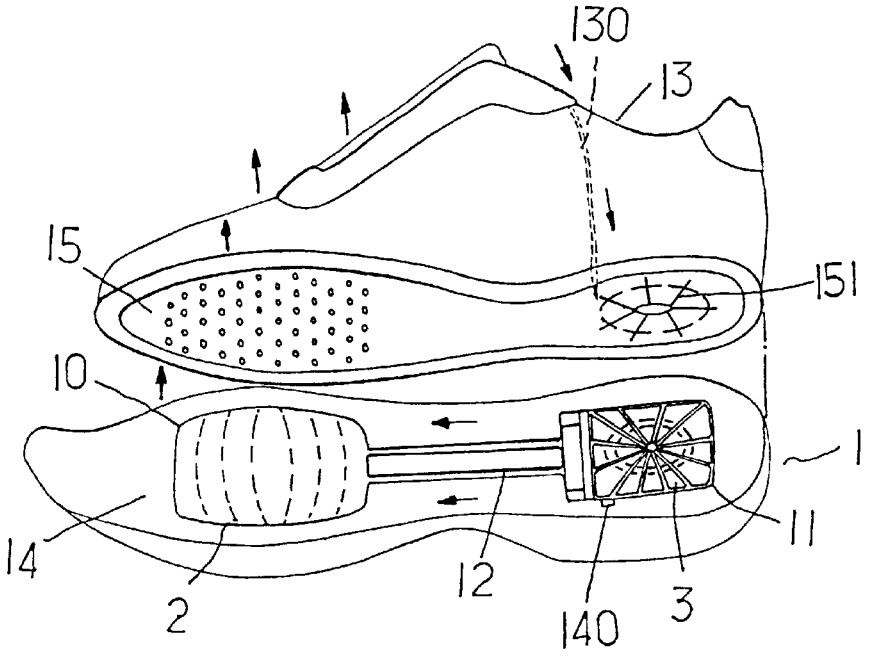
FIG. 9 is a schematic view showing the permeation of air from an opening of a different shoe of the present invention.
Figure 4:
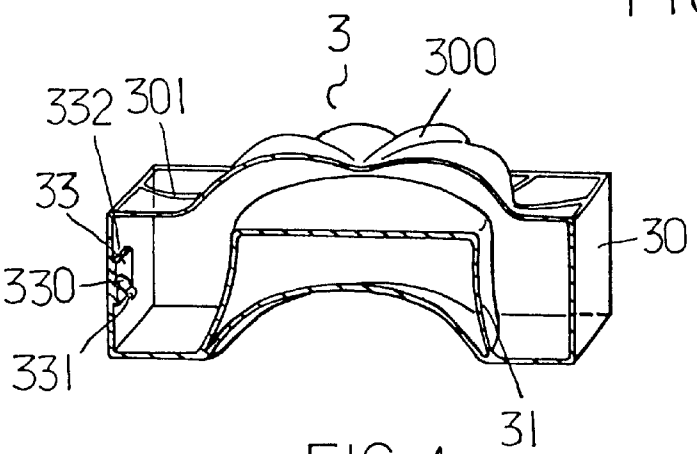
FIG. 4 is a partial cross sectional view of the air pump of the present invention.
Figure 6:
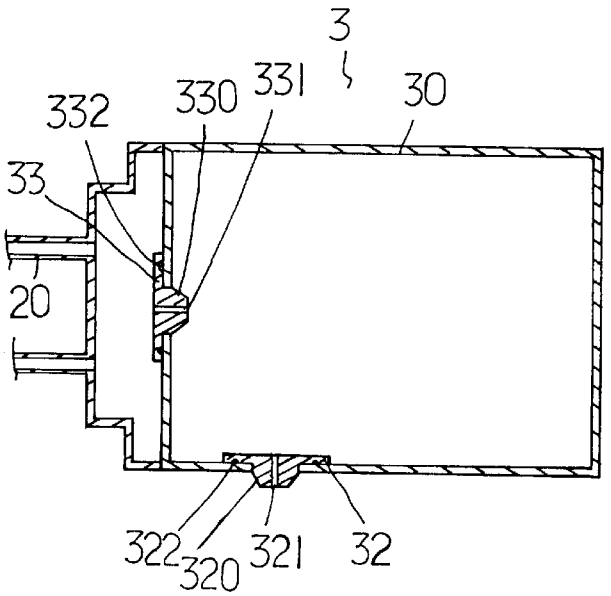
FIG. 6 is an elevation cross sectional view showing the piston of FIG. 5 installed to an air pump.
Figure 5:
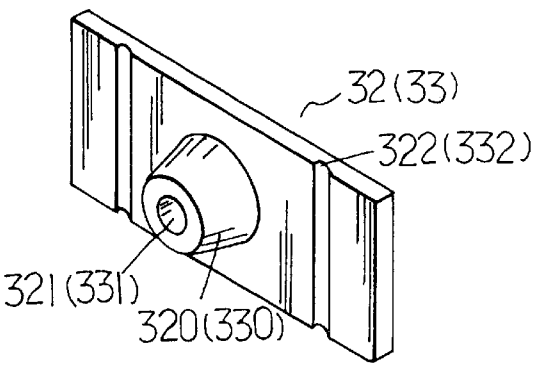
FIG. 5 is a hemi-cone protrusion piston of the present invention.

The air pump 3 has a rectangular body 30 (see FIG. 4). The top of the rectangular body 30 is installed with round lobe surface 300. The top of the surface 300 has stripe shape grooves 301 (from the periphery to the center) for increasing the surface elasticity of the air pump 3, increasing the buffering effect as the user jumps, and prolonging the lifetime of the shoe. A hollow cylinder 31 is formed at the center of the bottom. Thus, as the air pump 3 is compressed or ventilates the air due to compression, the surface of the top will not collapse too much. The front inner surface of the air pump 3 and the outer surface of the left vertical periphery have hemi-cone shape pistons 32, 33 which serve to prevent whistling of air. Near two sides of the surface of the pistons 32 and 33, hemispherical grooves 322 and 332 are provided as seen in FIG. 6. The surfaces thereof are flatly adhered to the front inner surface and outer left side of the air pump 3 for absorbing driving force and increasing the plasticity (as shown in FIGS. 5 and 6). The center of the piston at the front end is installed with an air valve 321. The hemi-cone protrusions 320 of the piston 32 extend from the inner side to the outer side of air pump 3. The round air valve 321 serves to absorb and seal air. The piston 33 at the outer surface of the left vertical periphery is installed with air valve 331. The hemi-cone protrusion 330 of the piston 33 protrudes into the air pump 3. The round air valve 331 has the function of venting and sealing. Intermittent radiating strips 151 seen in FIG. 9 are formed at the rear side of the surface 15 of the air pump 3 so that the round lobe protrusion 300 at the air pump 3 may protrude out without being compressed.

Figure 7:
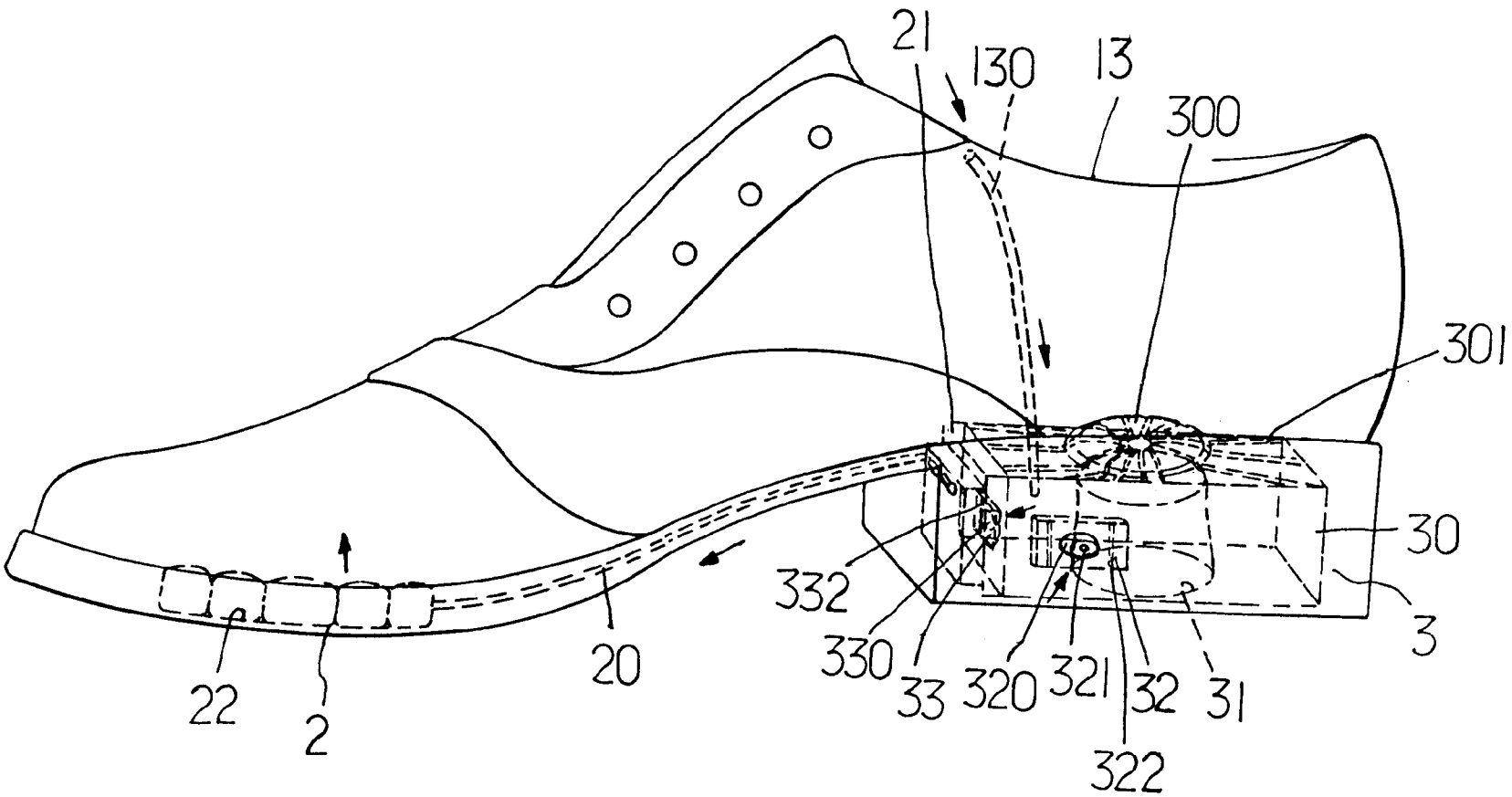
FIG. 7 is a schematic view showing air permeation of the assembly of FIG. 2 installed in the sole.
Figure 8:
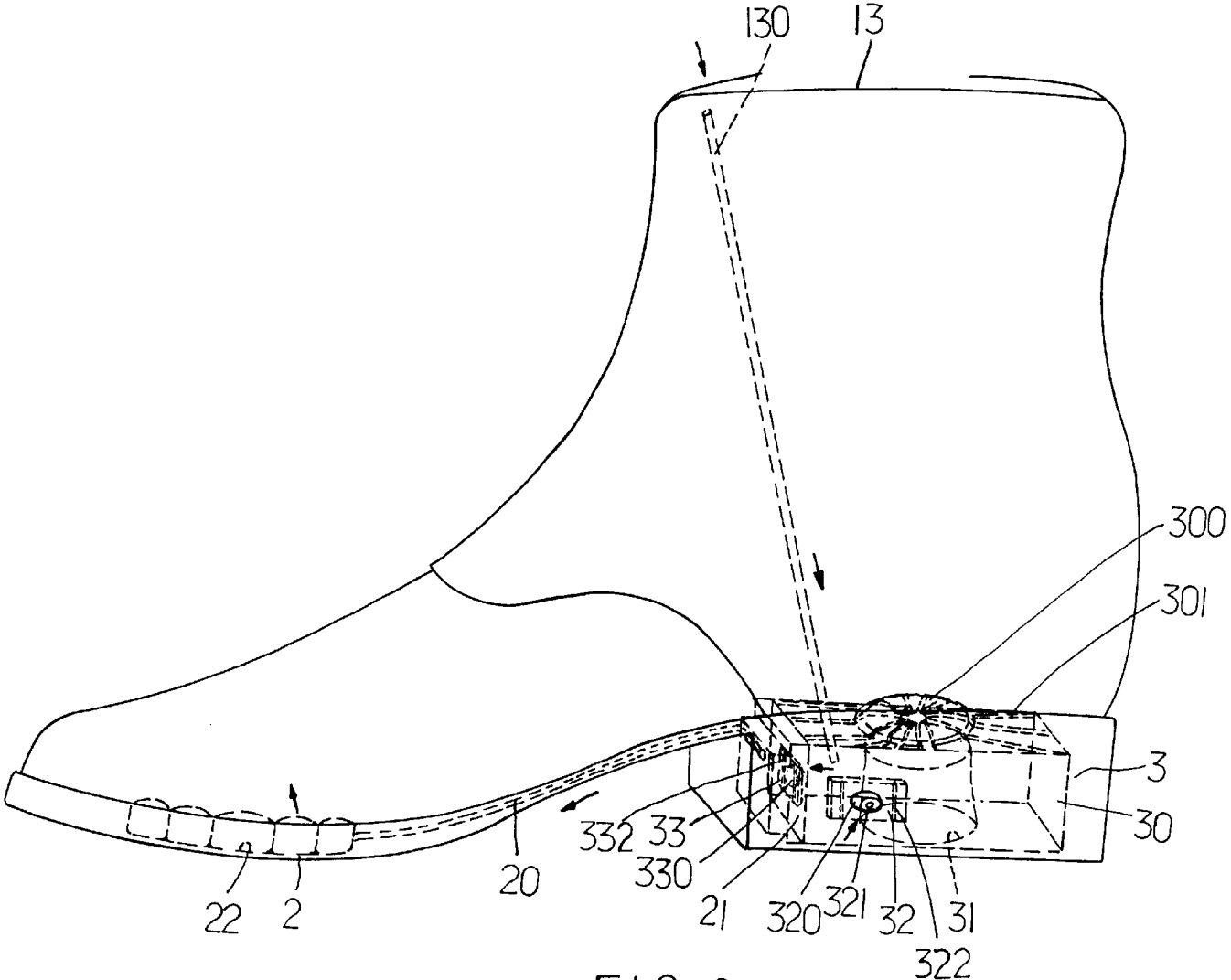
FIG. 8 is a schematic view showing air permeation of a sole of a different shoe of the assembly of FIG. 2.

In use (referring to FIGS. 7~9), when the bottom of the heel lifts to separate from the round lobe protrusion 300, this protrusion 300 will move upwards and the volume of the air pump 3 will increase to a half vacuum condition. Connected to a conduit input opening 140 at the rear groove 11 of the sole 1 is a plastic conduit 130 which extends between the lateral side of the shoe opening 13 and the clamping layer in the shoe. Since the exterior pressure is larger than that of the inside of air pump 3, air pushes forward to move toward the air pump 3 through the air valve 321 so that the hemi-cone protrusion piston 32 will be pushed away and thus released from the air valve 321. Therefore, air may flow into the air pump 3. Meanwhile, the air valve 331 in front end of the pump 3 will be pushed inwards, so that the hemi-cone protrusion piston 33 of the air valve 331 will further extrude into the air pump 3 to seal the valve completely and thus, air is isolated. When the heel hits the ground, the round lobe protrusion 300 of the air pump 3 will be pressed. Thus, the inside air has a larger pressure than the outer side so as to extrude the outer air so that the hemi-cone protrusion piston 33 on the air valve 331 will be pushed away to be released from the air valve 331 so that the air in the air pump 3 will ventilate out to the front end air transfer conduit 20 and move to the front foot 14. Meanwhile, since the air valve 321 at the lateral side of the air pump 3 will be extruded to the outer side, therefore, the hemi-cone protrusion piston 32 on the air valve 321 will press the air pump 2 so that the air valve is sealed completely, and thus, air is isolated and not be ventilate therefrom. Therefore, the air valve 321 at the rear side of the air pump 3 only serves for absorbing air, not for releasing air. While the air valve 31 at the front end only serves to ventilate air, not to absorb air. When walking, the heel moves upwards and downwards, in the air pump 3, by the operation of the air pump 3 and the control of the hemi-cone protrusion 32 and 33 of the air valves 321 and 331, the outer air can be transferred continuously to the front foot 14. Therefore, the air in the shoe can be taken in from outside and flow successfully, and the shoe will not be too hot. Moreover, the shoe becomes more soft and elastical.

The above described embodiments are not intended to limit the scope of the present invention, as one skilled in the art can, in view of the present invention, expand such embodiments to correspond with the subject matter of the present invention claimed below. Therefore, all such substitutions and modifications are intended to be embraced within the scope of the invention as defined in the appended claims.

What is claimed is:

1. A shoe with an air pump comprising:

a sole with a front end and a rear end;

a groove in the front of the sole and a groove in the rear of the sole;

a lobe shaped air bag receivable in the front groove of the sole, the air pump being received in the rear groove of the sole, the lobe shaped air bag having an elongated flat shape and having lobes arranged in a surface thereof to form isolating air chambers in the lobe shaped air bag, the lobes being spaced by a stripe, the stripes being formed as a supporting frame from a lower side to an upper surface of the sole;

a plurality of gaps being provided in the stripes of each of the lobes such that air in the lobe shaped air bag can circulate within the bag, bending of the shoe by movement of a foot wearing the shoe causing circulation of air;

trenches extending in the sole between the front and rear grooves;

air transfer conduits in the trenches which connect the lobe shaped air bag and the air pump;

an air chamber connected to the air transfer conduits for buffering air moving to the lobe shaped air bag to reduce whistling sound of the air;

the air pump having a body with a top of the body having a round lobe surface with a plurality of radiating strip-shaped grooves therein, the grooves increasing surface elasticity of the air pump and increasing a buffering effect as a user jumps to thereby prolong a lifetime of the shoe;

a hollow cylinder being provided at a center of the bottom of the shoe to prevent excessive compression of the top surface of the air pump as the air pump is compressed or vented;

frustrated-cone shaped pistons being provided on a front inner surface and a side of an outer surface of the air pump, a center of each of the pistons being provided with an air valve, the pistons having a hemi-cone protrusion, the air valves acting to permit flow of air in one direction such that the air valve on the side of the outer surface of the air pump permits inflow of air to the air pump and the air valve on the front surface of the air pump permits outflow of air from the air pump, both of the pistons also sealing the air pump to prevent back-flow of air, the pistons including intermittent radiating strips; and an input conduit extending from a side of the shoe opening to the rear groove of the sole;

whereby when a heel is lifted to move in a direction away from the round lobe surface of the air pump, volume of the air pump will increase to be in a vacuum condition and air will be drawn through the input conduit through the piston on the side of the air pump and into the air pump, the hemi-cone protrusion of the piston on the side of the air pump will move toward the air pump in order to release the air valve and allow air to flow into the pump and the air valve in the piston in the front of the pump will be pushed inwards so that the hemi-come protrusion of the piston of the air valve will seal the pump to isolate air in the pump;

whereafter when the shoe impacts the ground, the round lobe protrusion of the air pump will be pressed and pressure of air inside the pump will increase, whereby the hemi-cone protrusion of the piston on the front of the air pump will be pushed away from the air pump to release the air valve so that air in the air pump will vent out through the air transfer conduits to the lobe shaped air bag and meanwhile the air valve on the side of the air pump will be closed with the hemi-cone protrusion of the piston will seal the pump to isolate air from in the pump from the input conduit, air from the lobe shaped air bag being released into the shoe in order to cool an interior of the shoe;

whereby the air valve at the side of the air pump serves only for inflow of air into the air pump and the air valve at the front of the air pump serves only for outflow of air from the air pump and whereby when walking, air can be continuously flowing from outside the shoe to inside the shoe.

2. The shoe with an air pump as recited in claim 1, wherein the stripe in the lobes has a 3 mm width.

3. The shoe with an air pump as recited in claim 1, wherein the gaps in the stripes is 3 mm.

4. The shoe with an air pump as recited in claim 1, wherein the body of the air pump is rectangular in shape.

5. The shoe with an air pump as recited in claim 1, wherein the input conduit is plastic and extends from a side of the shoe opening to the rear groove of the sole.

* * * * *